US006135583A

United States Patent [19]

Simon et al.

[11] Patent Number: 6,135,583

[45] Date of Patent: Oct. 24, 2000

[54] STORAGE UNIT

[75] Inventors: David Eric Simon, San Francisco; Jess Allen Sorel, Castro Valley; Christopher Lyle Domina; Johnson Kwoksum Chow, both of San Francisco; Lewis Mark Epstein, San Mateo; Stephen Don Wahl, San Francisco, all of Calif.

[73] Assignee: Steelcase Development Inc., Caledonia, Mich.

[21] Appl. No.: 09/197,180

[22] Filed: Nov. 20, 1998

[51] Int. Cl.[7] ..... A47B 43/00

[52] U.S. Cl. ..... 312/257.1; 312/223.6; 312/265.5; 108/189; 108/190; 108/50.02

[58] Field of Search ..... 312/265.1, 265.2, 312/265.3, 265.4, 257.1, 223.1, 223.6, 111; 108/180, 182, 193, 192, 189, 106, 50.02, 186, 190

[56] References Cited

U.S. PATENT DOCUMENTS

| | | | |
|---|---|---|---|
| 1,261,652 | 4/1918 | Thorn . | |
| 2,104,913 | 1/1938 | Streeter . | |
| 2,902,328 | 9/1959 | Auer . | |
| 3,178,246 | 4/1965 | Riles | 312/265.4 |
| 3,192,306 | 6/1965 | Skonnord | 312/265.5 X |
| 3,220,790 | 11/1965 | White . | |
| 3,490,822 | 1/1970 | Gigante | 312/265.4 |
| 3,636,893 | 1/1972 | Lange | 108/190 |
| 3,730,604 | 5/1973 | Misenheimer, III | 312/111 X |
| 3,807,320 | 4/1974 | Textoris | 108/186 X |
| 3,828,937 | 8/1974 | Nash | 312/257.1 X |
| 4,015,545 | 4/1977 | Kurokawa | 312/265.5 X |
| 4,108,514 | 8/1978 | Zimmerman . | |
| 4,274,547 | 6/1981 | Takagi et al. | 312/265.5 X |
| 4,338,990 | 7/1982 | Blodee et al. | 312/265.5 X |
| 4,669,790 | 6/1987 | Briggs . | |
| 4,706,573 | 11/1987 | Sielaff | 108/190 |
| 4,718,741 | 1/1988 | Nichoalds . | |
| 4,747,644 | 5/1988 | Gallery et al. . | |
| 4,760,800 | 8/1988 | Hanson | 108/190 |
| 5,039,177 | 8/1991 | Newell et al. . | |
| 5,205,630 | 4/1993 | Welch et al. . | |
| 5,486,041 | 1/1996 | Sykes . | |
| 5,489,938 | 2/1996 | Maruyama et al. . | |
| 5,584,546 | 12/1996 | Gurin et al. . | |
| 5,611,553 | 3/1997 | Schoeman et al. . | |
| 5,713,584 | 2/1998 | Crane | 312/265.4 X |
| 5,933,563 | 8/1999 | Schaffer et al. | 312/223.6 X |
| 5,941,183 | 8/1999 | Ming-Shun | 108/190 X |

*Primary Examiner*—Anthony D. Barfield
*Assistant Examiner*—Hanh V. Tran

[57] ABSTRACT

A storage unit for use in a work environment includes a base assembly, a top assembly mounted upon the base assembly, and a vertical partition assembly installed between the base assembly and the top assembly dividing a space therebetween into a first section and a second section. The vertical partition assembly may provide a vertical passage so that utilities may be passed between the top assembly to the base assembly and between the first section and the second section. A fixed shelf assembly with an upper vertical partition assembly installed between the fixed shelf assembly and the top assembly may divide an upper space between the fixed shelf assembly and the top assembly into a first upper section and a second upper section. A lower vertical partition assembly is installed between the base and the fixed shelf assembly may divide a lower space between the base assembly and the fixed shelf assembly into a first lower section and a second lower section. A vertical passage may be provided by the top vertical partition assembly and the bottom vertical partition assembly (and through a shelf aperture in the fixed shelf assembly) so that utilities may be passed from the top assembly to the base assembly. The utilities may include any signal, such as voice, power or data. The storage unit may be provided with at least one exterior panel adapted for mounting between the base assembly and the top assembly.

55 Claims, 16 Drawing Sheets

STORAGE UNIT

FIELD OF THE INVENTION

The present invention generally relates to a storage unit adapted for use within a work environment. More particularly, the present invention relates to a storage unit capable of association with a variety of modular components in a variety of combinations. Still more particularly, the present invention relates to a storage unit having an internal vertical passage for utilities which can be distributed within the storage unit.

CROSS-REFERENCE TO RELATED APPLICATIONS

The following U.S. patent applications are cited by reference and incorporated by reference herein: (a) Ser. No. 09/197,178, titled "MOBILE SCREEN" filed on Nov. 20, 1998; (b) Ser. No. 29/096,803, titled "SCREEN" filed on Nov. 20, 1998; (c) Ser. No. 09/197,040, titled "SEATING PRODUCT" filed on Nov. 20, 1998; (d) Ser. No. 29/096,841, titled "SEATING PRODUCT" filed on Nov. 20, 1998.

BACKGROUND OF THE INVENTION

It is known to provide for a storage unit such as a cabinet or the like for use in a work environment. According to known arrangements, the cabinet will have a generally orthogonal shape (with one or more side or wall panels) and provide one or more sections or compartments within which materials of a wide variety of types may be placed. According to a well-known arrangement, the cabinet will be provided with one or more shelves, on which materials are placed. According to other known arrangements, the cabinet may also include one or more doors or drawers. Such known arrangements for cabinets are provided in a variety of shapes and sizes. However, such known cabinets do not typically provide for shared modular components, such as exterior panels.

It is also known to configure a cabinet to contain electrical or electronic equipment, such as video monitors, computing devices, stereo equipment, etc. Such known cabinets may include an opening or the like into the cabinet through an exterior panel allowing entry of cables for power and/or data signals that must be provided to such equipment. However, such known arrangements commonly do not provide for the passage of cables from one section within the cabinet to another section. Moreover, such known arrangements generally do not provide an internal passage for such cables or their management. As a result, it is not uncommon in such known arrangements to have cables at least partially visible "bunched" adjacent to or behind the equipment.

Accordingly, it would be advantageous to have a storage unit that includes an internal passage for cables for utilities such as voice, power and data that may selectively be routed into or through the storage unit as well as selectively made accessible to equipment placed within the storage unit. It would also be advantageous to have a storage unit of basic design that is configurable for a diverse range of activities including open and closed storage, information display in a variety of media, and technology support. It would further be advantageous to have a storage unit that facilitates the use of modular components, including exterior panels having a wide variety of constructions, finishes and surface treatments, within a storage unit or groups of storage units.

SUMMARY OF THE INVENTION

The present invention relates to a storage unit for use in a work environment including a base assembly, a fixed shelf assembly mounted upon the base assembly, and a top assembly mounted upon the fixed shelf assembly. The storage unit also includes an upper vertical partition assembly installed between the fixed shelf assembly and the top assembly dividing an upper space between the fixed shelf assembly and the top assembly into a first upper section and a second upper section, and a lower vertical partition assembly installed between the base and the fixed shelf assembly dividing a lower space between the base assembly and the fixed shelf assembly into a first lower section and a second lower section. The storage unit further includes a vertical passage provided by the top vertical partition assembly and the bottom vertical partition assembly and through a shelf aperture in the fixed shelf assembly so that utilities may be passed from the top assembly to the base assembly.

The present invention also relates to a storage unit for use in a work environment including a base assembly, a top assembly mounted upon the base assembly, a vertical partition assembly installed between the base assembly and the top assembly dividing a space between the base assembly and the top assembly into a first section and a second section, a vertical passage provided by the vertical partition assembly so that utilities may be passed between the top assembly to the base assembly and between the first section and the second section.

The present invention further relates to a storage unit for use in a work environment including a base assembly, a top assembly mounted upon the base assembly, and a vertical partition assembly installed between the base assembly and the top assembly dividing a space between the base assembly and the top assembly into a first section and a second section. The storage unit also includes a vertical passage provided by the vertical partition assembly so that utilities may be passed between the top assembly and the base assembly and between the first section and the second section. A cover is adapted for selective installation to the vertical partition assembly so that when the cover is installed the vertical passage is at least partially concealed. The vertical partition assembly includes a plurality of bracket tabs adapted for managing utilities within the vertical passage.

DETAILED DESCRIPTION OF THE PREFERRED EMBODIMENTS

Figure 1A:
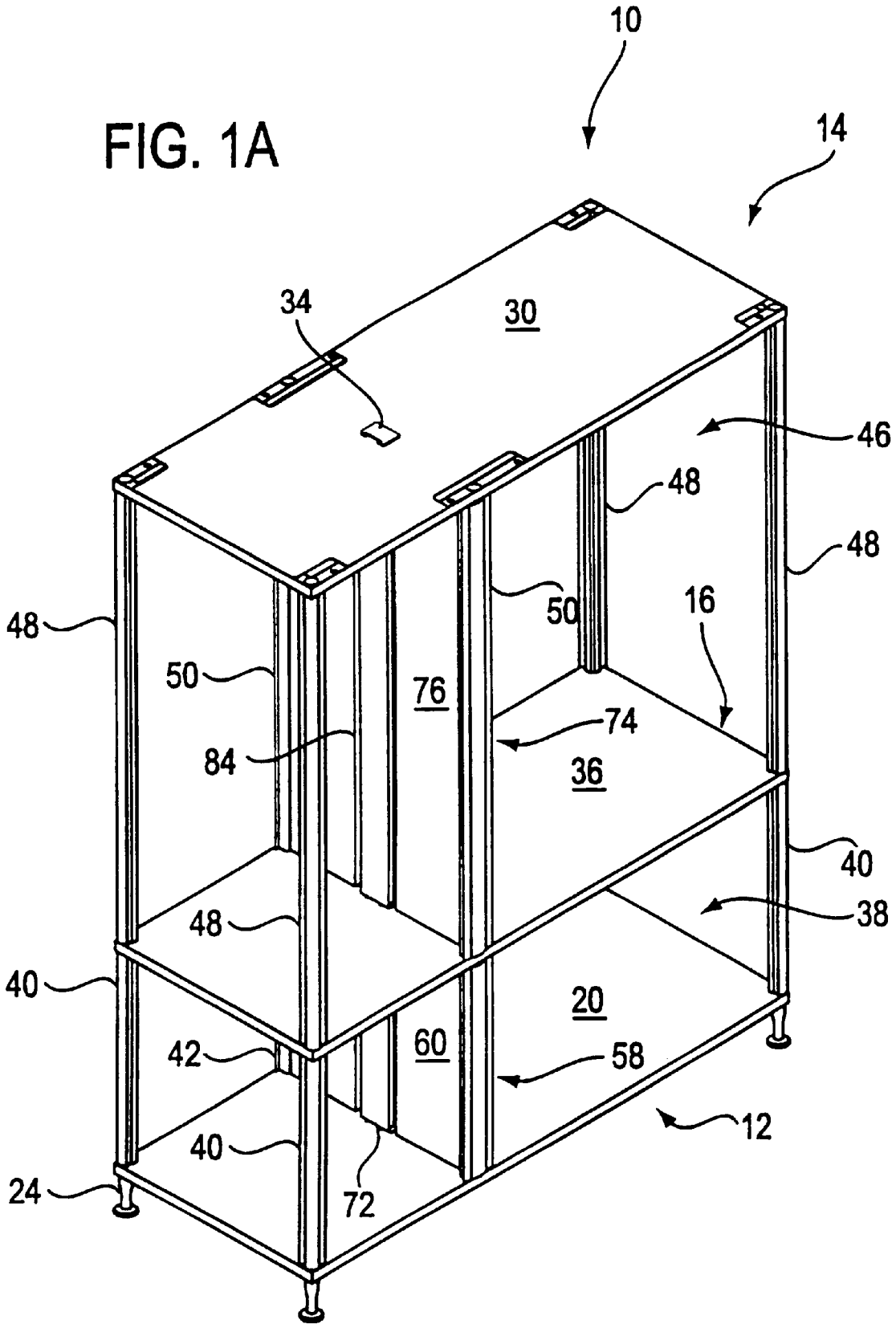
FIG. 1A is a perspective view of the storage unit according to a exemplary embodiment of the present invention.
Figure 1B:
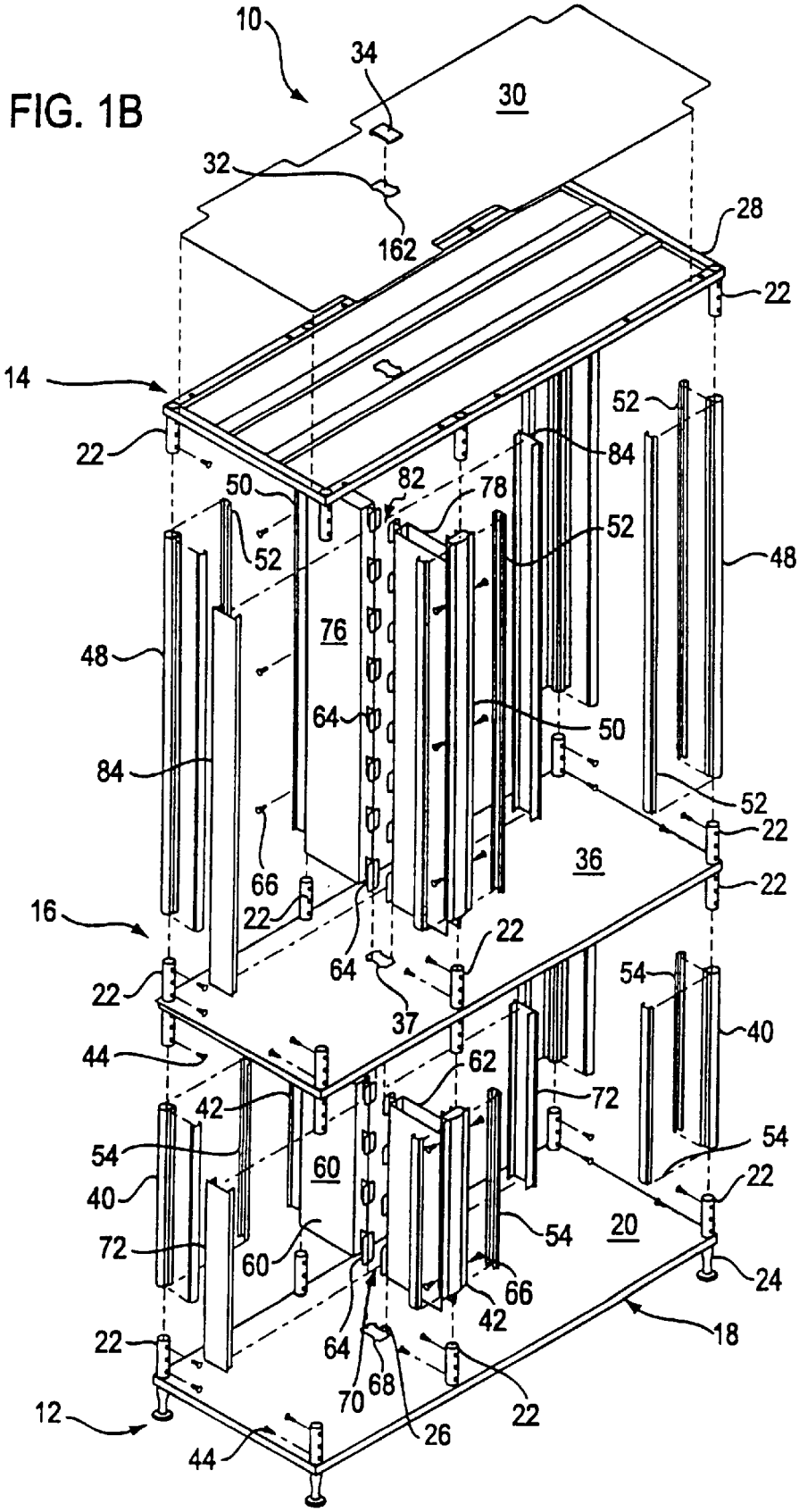
FIG. 1B is an fragmentary exploded perspective view of the storage unit.

Referring to FIGS. 1A and 1B, a storage unit 10 is shown according to an preferred embodiment of the present invention. Storage unit 10 includes a base assembly 12 and a top assembly 14. Storage unit 10 also includes a fixed shelf assembly 16 installed between base assembly 12 and top assembly 14.

Base assembly 12 includes a base frame 18 providing a base shelf 20 of a generally rectangular shape. Base assembly 12 also includes six upwardly projecting mounting tubes 22 installed at each of four corners and at an intermediate edge position of base frame 18. At each of four corners of base frame 18 (opposite to each of four mounting tubes 22) are each of four downwardly projecting glides 24 (e.g. height-adjustable glides) on which storage unit 10 may stand fixed upon a surface (such as a floor). A base aperture 26 is provided through base assembly 12.

Top assembly 14 includes a top frame 28 of a generally rectangular shape. Top assembly also includes six downwardly projecting mounting tubes 22 installed at each of four corners and at an intermediate edge position of top frame 28. A top 30 (or lid) is installed within top frame 28. A top aperture 32 with a removable cap shown as plastic grommet 34 is provided through top assembly 14.

Fixed shelf assembly 16 includes a shelf 36 of a generally rectangular shape. Fixed shelf assembly 16 also includes six downwardly projecting mounting tubes 22 opposite to six upwardly projecting mounting tubes 22 at each of four corners and at an intermediate edge position of shelf 36. A shelf aperture 37 is provided through fixed shelf assembly 16.

To form a lower section 38 of storage unit 10, fixed shelf assembly 16 is mounted to base assembly 12 by a four vertical frame members shown as lower corner extrusions 40 and two vertical frame members shown as lower middle extrusions 42, which fit over each of downwardly projecting mounting tubes 22 of fixed shelf assembly 16 and each of upwardly projecting mounting tubes 22 of base assembly 12. Each of lower corner extrusions 40 and lower middle extrusions 42 are secured to mounting tubes 22 of fixed shelf assembly 16 and base assembly 14 by fasteners shown as screws 44.

To form an upper section 46 of storage unit 10, top assembly 14 is mounted to fixed shelf assembly 16 by a four vertical frame members shown as upper corner extrusions 48 and two vertical frame members shown as upper middle extrusions 50, which fit over each of downwardly projecting mounting tubes 22 of top assembly 14 and each of upwardly projecting mounting tubes 22 of fixed shelf assembly 16. Each of upper corner extrusions 48 and upper middle extrusions 50 are secured to mounting tubes 22 of top assembly 14 and fixed shelf assembly 16 by fasteners shown as screws 44 (two are shown at each location).

According to a particularly preferred embodiment, each of the vertical frame members (e.g. extrusions) has a generally hollow but suitably rigid form and is made of aluminum. As shown, protective trim pieces or snap-fitting "bumpers" shown as lower and upper vinyl extrusions 52 and 54 may be installed within grooves 57 on exposed edges of each of the vertical frame members of storage unit 10 (see FIG. 9). According to any particularly preferred embodiment, the vinyl extrusions are intended to protect the vertical frame members from damage and wear during use of the storage unit.

A lower partition assembly 58 divides lower section 38 into a right lower section 38*a* and a left lower section 38*b* (as shown, a larger section and a smaller section). Lower partition assembly 58 is installed across lower middle extrusions 42 between base assembly 12 and fixed shelf assembly 16. Lower partition assembly 58 includes two dividers shown as spine dividers 60. Each of spine dividers 60 has a generally hollow body 62 (e.g. a rectangular tube) and a plurality of vertically-aligned bracket tabs 64. Body 62 of each spine divider 60 is engaged by and mounted to corresponding lower middle extrusion 42, secured by fasteners shown as screws 66 (e.g. self-drilling screws). During assembly, lowermost bracket tab 64 of each spine divider 60 is partially retained within corresponding slots 68 in base aperture 26 of base assembly 12 (and uppermost bracket tab 64 of each spine divider 60 is partially retained within corresponding slots 80 in shelf aperture 37 of fixed shelf assembly 16). Lower partition assembly 58 provides a lower vertical passage 70 between base aperture 26 and shelf aperture 37 of fixed shelf assembly 16. Lower vertical passage 70 is accessible from either right lower section 38*a* or left lower section 38*b* of storage unit 10. A cover 72 may be installed on each side (e.g. right and left) of lower vertical passage 70.

An upper partition assembly 74 divides upper section 46 into a right upper section 46*a* and a left upper section 46*b* (as shown, a larger section and a smaller section). Upper partition assembly 74 is installed across upper middle extrusions 50 between fixed shelf assembly 16 and top assembly 14. Upper partition assembly 74 includes two dividers shown as spine dividers 76. Each of spine dividers 76 has a generally hollow body 78 (e.g. a rectangular tube) and a plurality of vertically-aligned bracket tabs 64. Body 78 of each spine divider 76 is engaged by and mounted to corresponding upper middle extrusion 50, secured by fasteners shown as screws 66 (e.g. self-drilling screws). During assembly, lowermost bracket tab 64 of each spine divider 76 is partially retained within corresponding slots 80 in shelf aperture 37 of fixed shelf assembly 16 (and uppermost bracket tab 64 of each spine divider 76 is partially retained within corresponding slots 162 in top aperture 32 of top assembly 14). Upper partition assembly 74 provides an upper vertical passage 82 between shelf aperture 37 and top aperture 32 of top assembly 14. Upper vertical passage 82 is accessible from either right upper section 46*a* or left upper section 46*b* of storage unit 10. A cover 84 may be installed on each side (e.g. right and left) of upper vertical passage 82. (According to any preferred embodiment, the spine dividers of the lower partition assembly and the spine dividers of the upper partition assembly have a similar construction, though they may be of different sizes.)

As shown in the Figures, according to a particularly preferred embodiment, when storage unit 10 is assembled it provides four orthogonal sections that may be subdivided, covered or otherwise configured or used for any of a variety of applications: right upper section 46*a*, left upper section 46*b*, right lower section 38*a*, and left lower section 38*b*. According to a particularly preferred embodiment, of a type shown in FIGS. 3A through 3E the storage unit has an overall height of approximately 78 inches, a width of approximately 26 inches, and a length of approximately 58 inches; the storage unit also has a one-third to two-third "proportion" (or aspect), with the left upper section and left lower section each being occupying one-third of the overall length of the storage unit, and the right lower section and left lower section each occupying approximately one-third of the overall height of the storage unit. According to any preferred embodiment, the storage unit will be provided in any size and proportion suitable for the intended application.

Figure 1C:
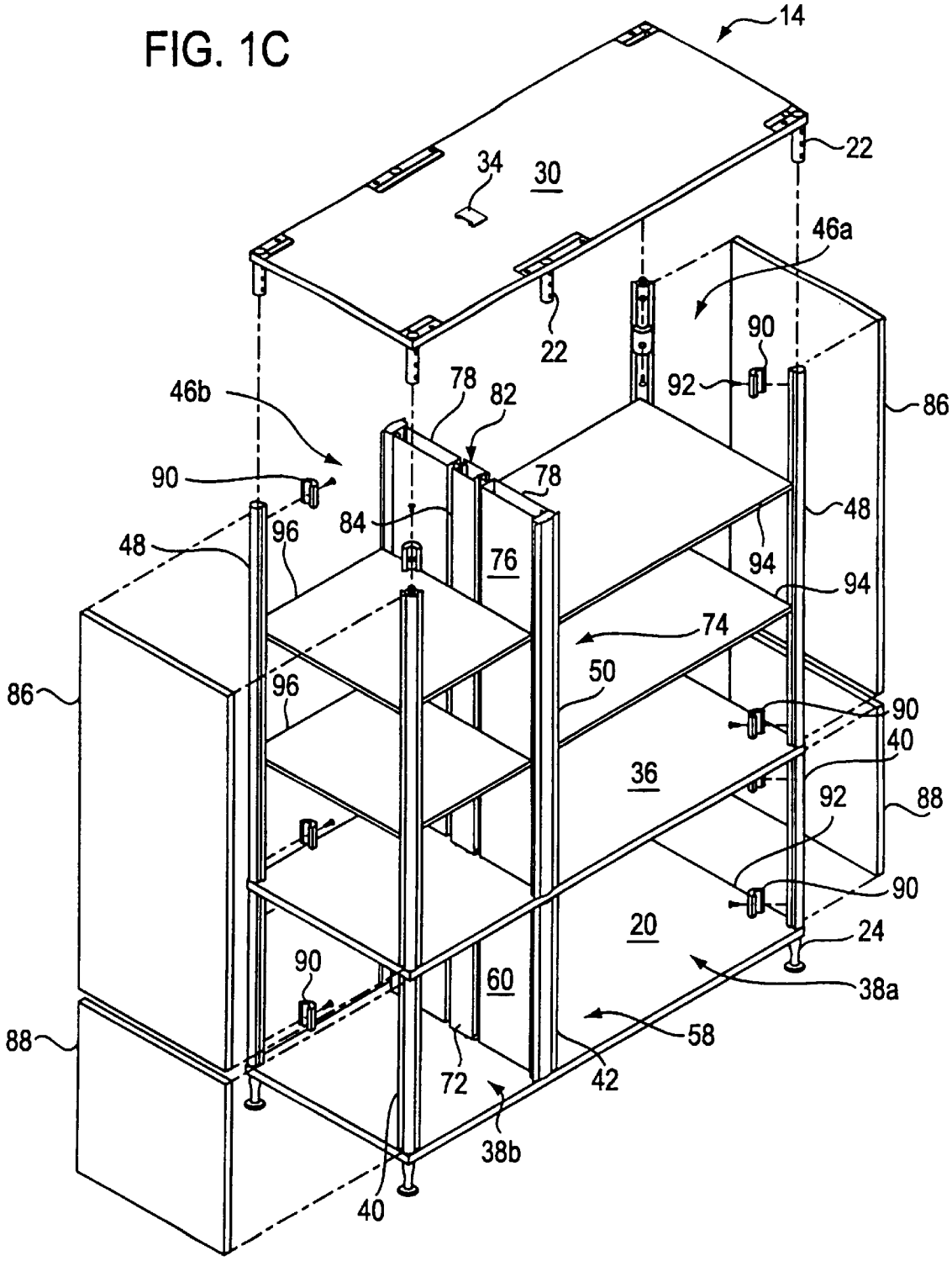
FIG. 1C is a partially exploded perspective view of the storage unit according to an exemplary embodiment.
Figure 2:
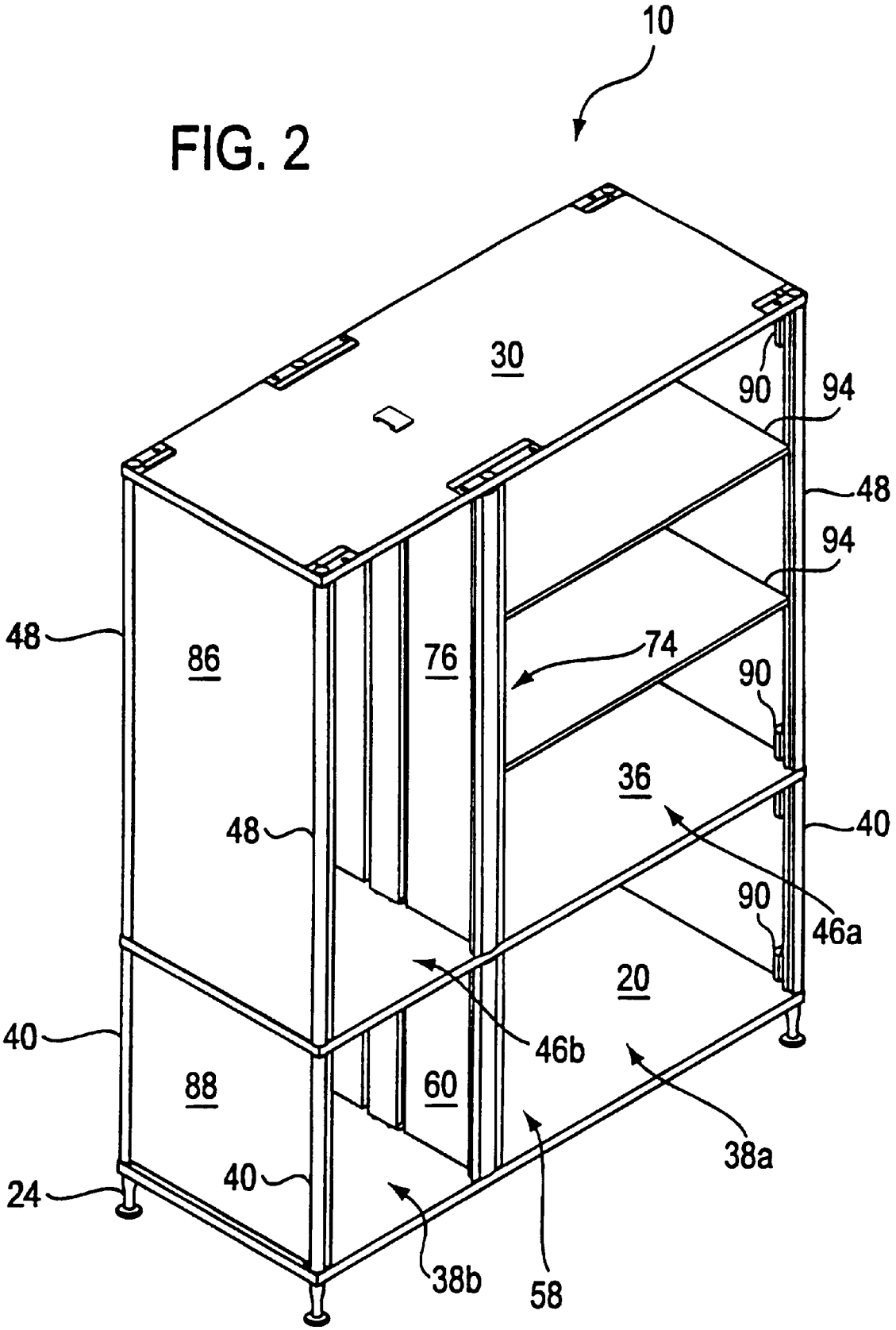
FIG. 2 is a perspective view of the storage unit according to an exemplary embodiment of the present invention.
Figure 3C:
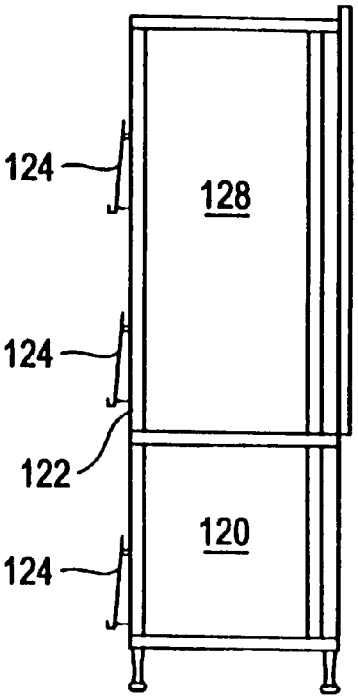
FIGS. 3C and 3E are right and left side elevation views of the storage unit of FIG. 3A.
Figure 3B:
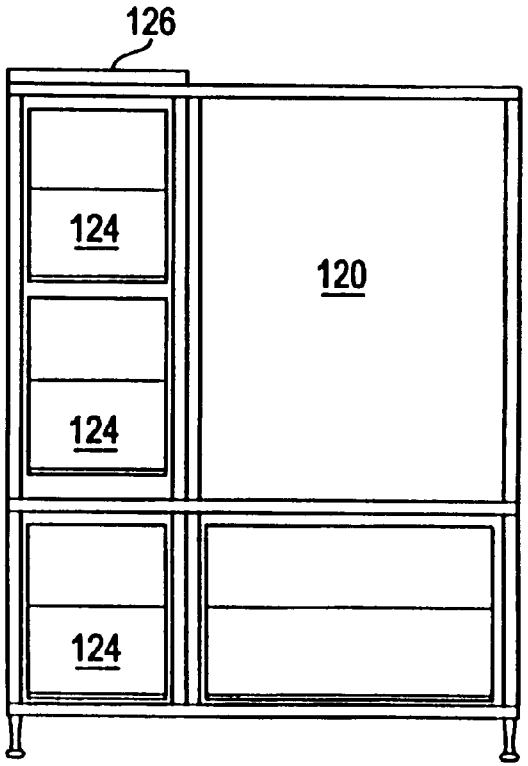
FIGS. 3B and 3D are front and rear elevation views of the storage unit of FIG. 3A.
Figure 3A:
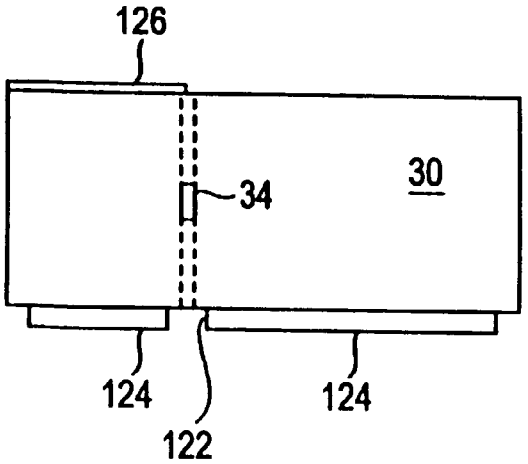
FIG. 3A is a top plan view of the storage unit according to an exemplary embodiment.
Figure 3E:
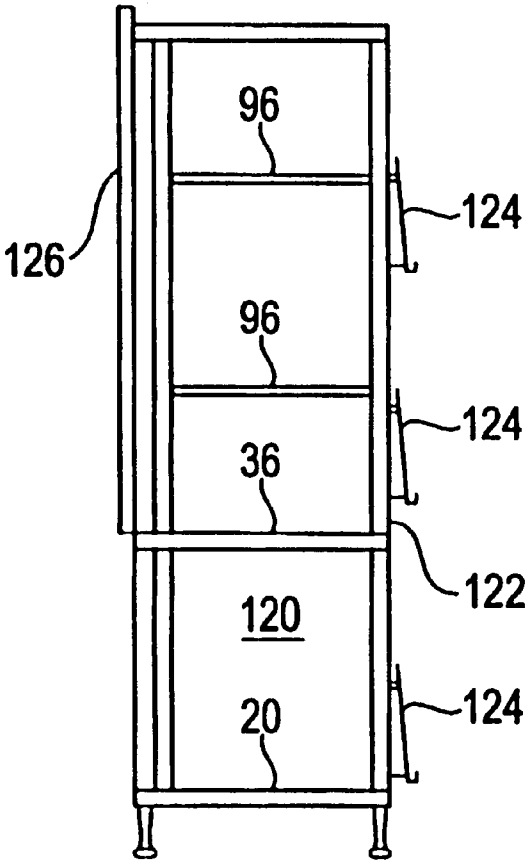
Figure 3D:
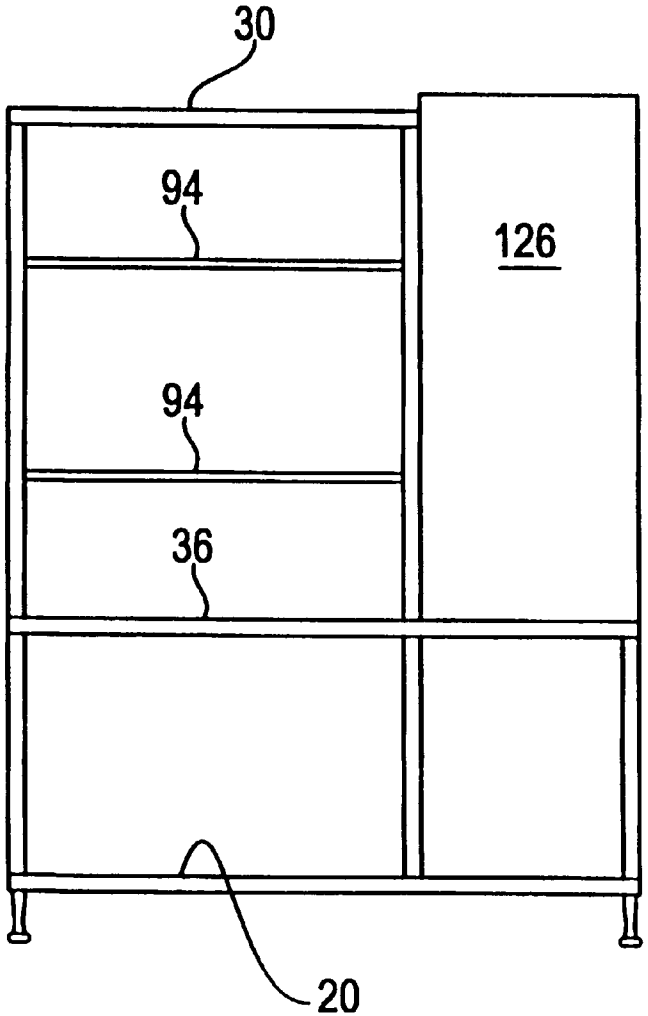
Figure 9:
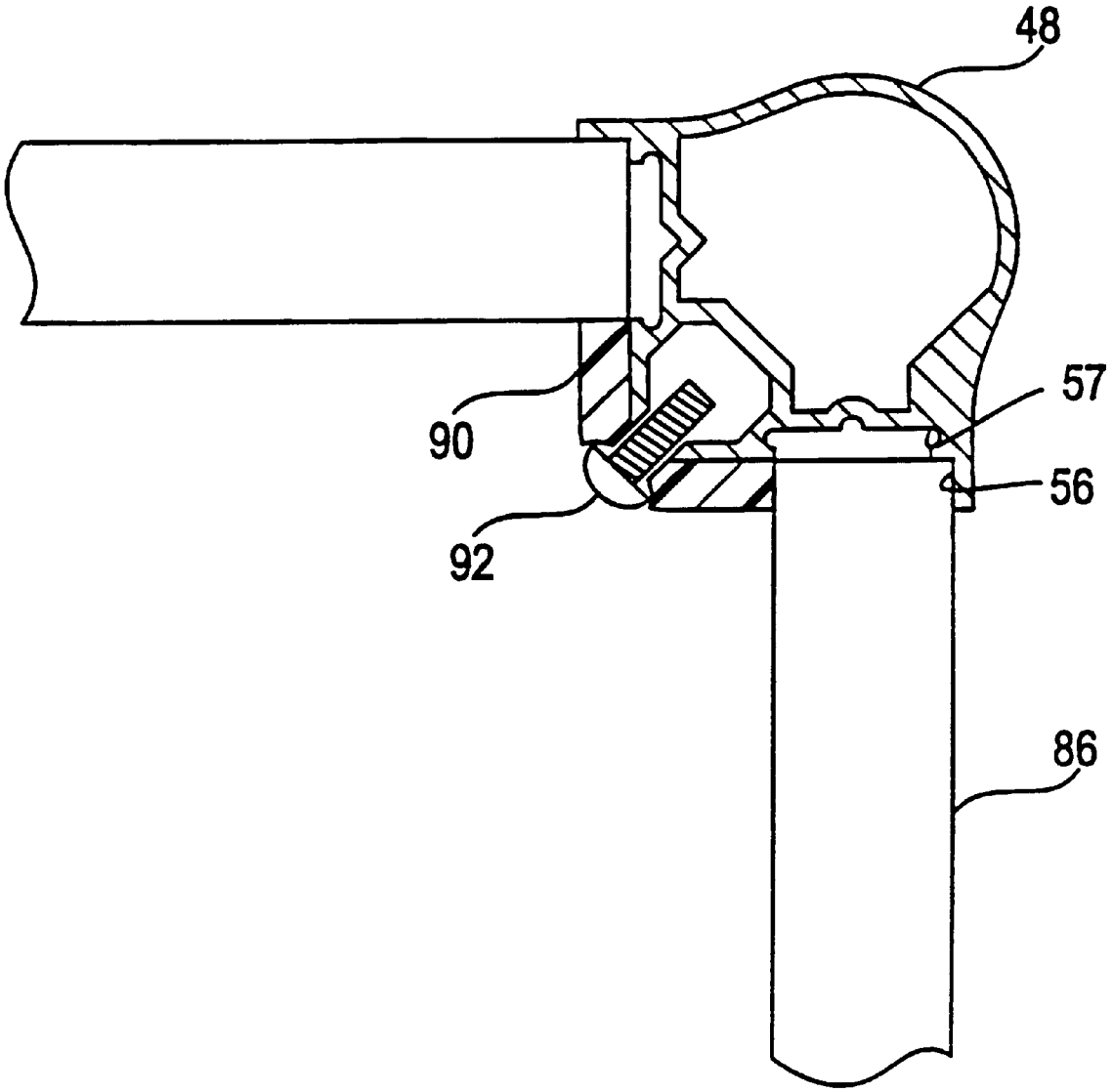
FIG. 9 is a fragmentary top plan view of a vertical frame assembly of the storage unit according to the exemplary embodiment of FIG. 2.

As shown in the exemplary embodiments of FIGS. 1C and 2, storage unit 10 may be provided with one or more exterior panels shown as upper end panels 86 and lower end panels 88 (see also FIGS. 9 through 14). Upper end panels 86 are installed across upper corner extrusions 48 (i.e. "captured" within grooves 56) and between fixed shelf assembly 16 and top assembly 14; upper end panels 86 are secured to upper corner extrusions 48 by retaining clips 90. Lower end panels 88 are installed across lower corner extrusions 40 (i.e. "captured" within grooves) and between base assembly 12 and fixed shelf assembly 16; lower end panels 88 are secured to lower corner extrusions 40 by retaining clips 90. As shown in FIG. 9, retaining clip 90 is secured to corner extrusion by a fastener shown as a screw 92. According to a particularly preferred embodiment, the retaining clip is made of an ABS plastic material.

Figure 8:
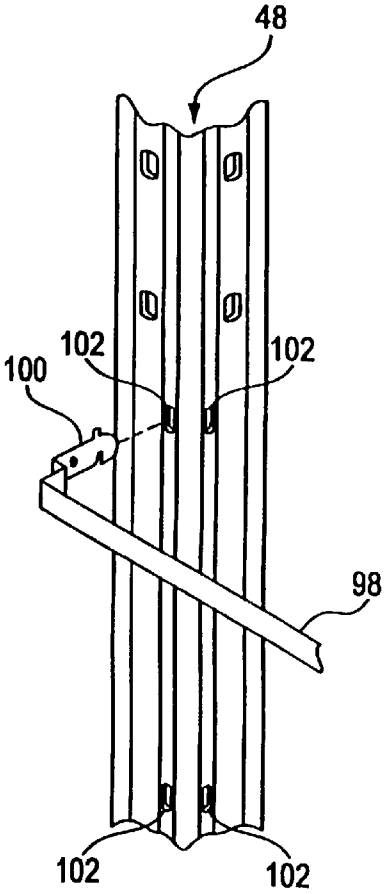
FIG. 8 is a fragmentary perspective view of a shelf support assembly of the storage unit according to the exemplary embodiment of FIG. 7.
Figure 7:
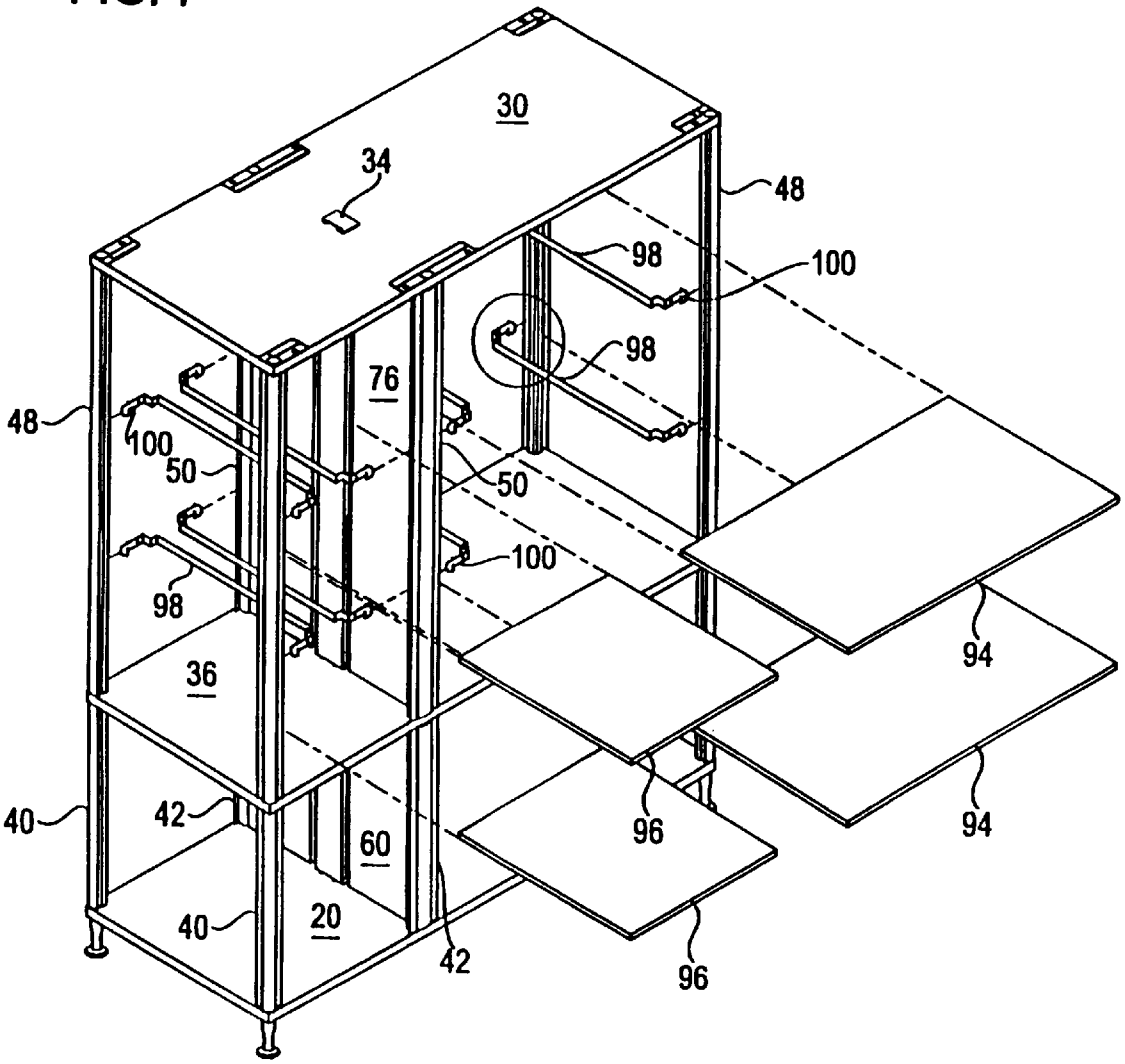
FIG. 7 is a partially exploded perspective view of the storage unit according to an exemplary embodiment.

As also shown in FIGS. 1C and 2, storage unit 10 may be provided with one or more intermediate shelves shown as right section shelves 94 and left section shelves 96 (e.g. "floating" shelves). According to any preferred embodiment, the intermediate shelves are removable and repositionable (e.g. height-adjustable) within the storage unit. As shown with reference to the particularly preferred embodiment of FIGS. 7 and 8, intermediate shelves 94 or 96 rest on repositionable shelf support brackets 98 having hooks 100 at each end that may be fixedly retained in any paired set of slots 102 located at predetermined heights within corner extrusions 40 or 48 or middle extrusions 42 or 50. According to alternative embodiments, any of a variety of other shelf-mounting arrangements may be employed.

Figure 4:
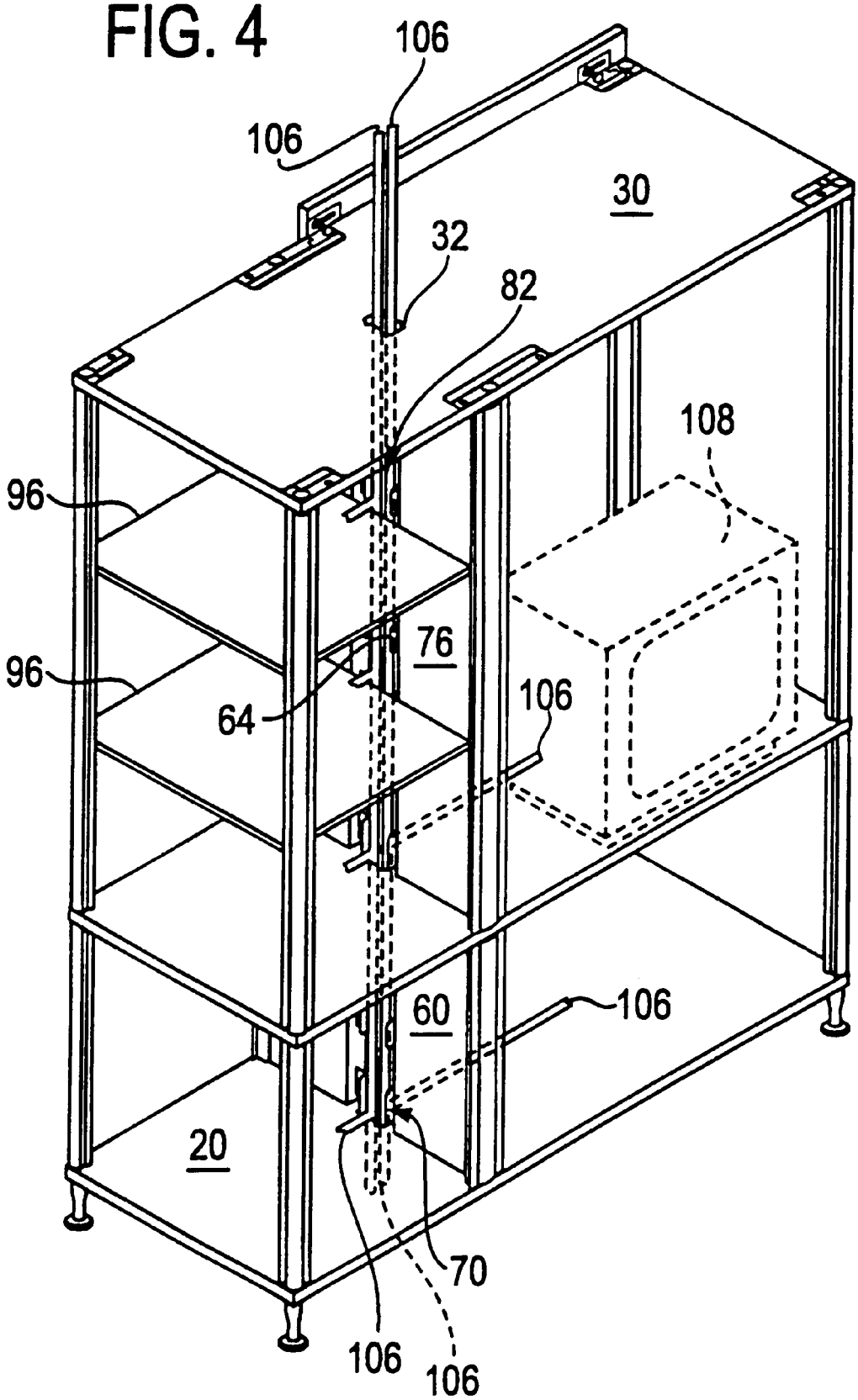
FIG. 4 is a perspective view of the storage unit according to an exemplary embodiment.
Figure 5A:
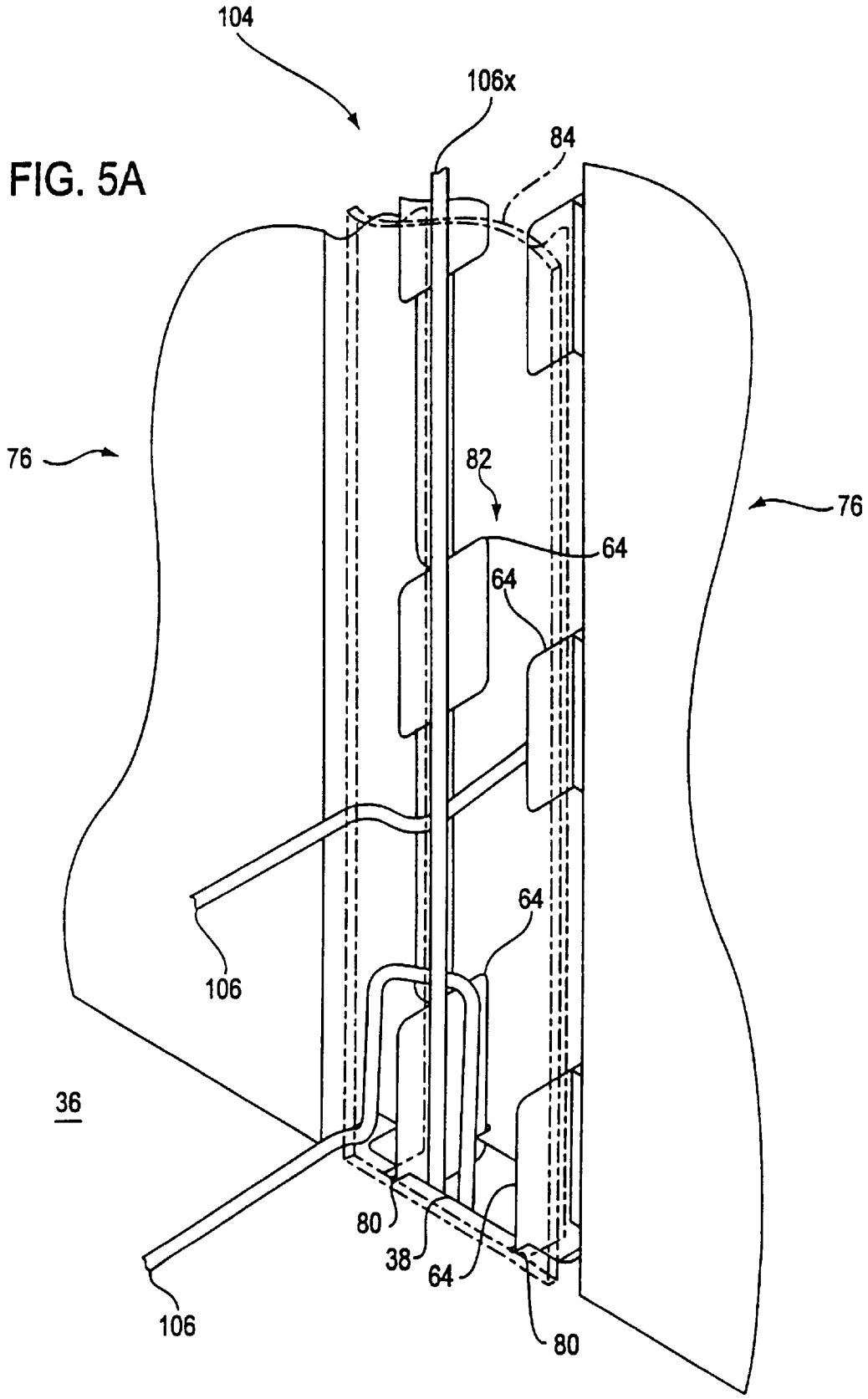
FIGS. 5A through 5C are fragmentary perspective views of a utility management system of the storage unit according to a particularly preferred embodiment.
Figure 5B:
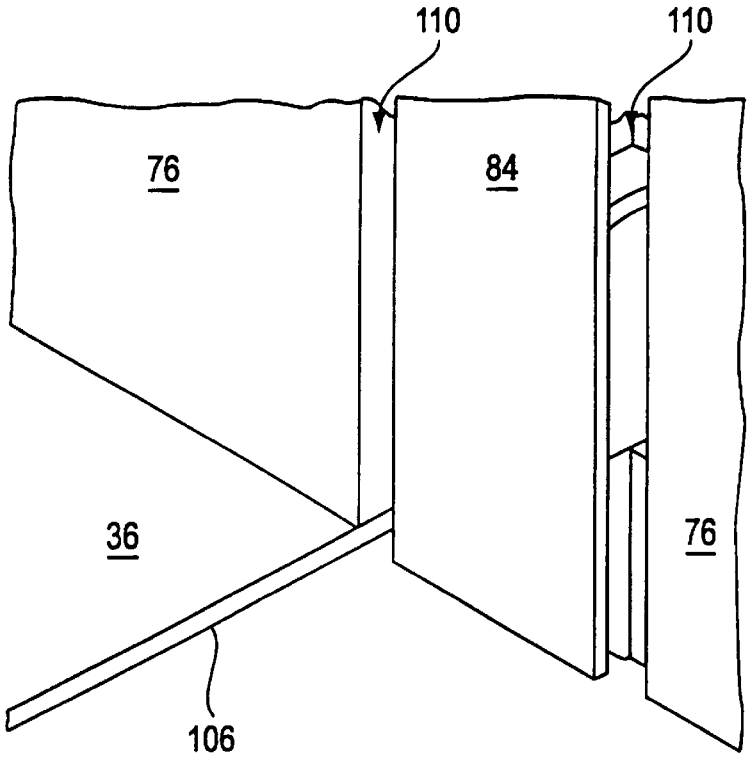
Figure 5C:
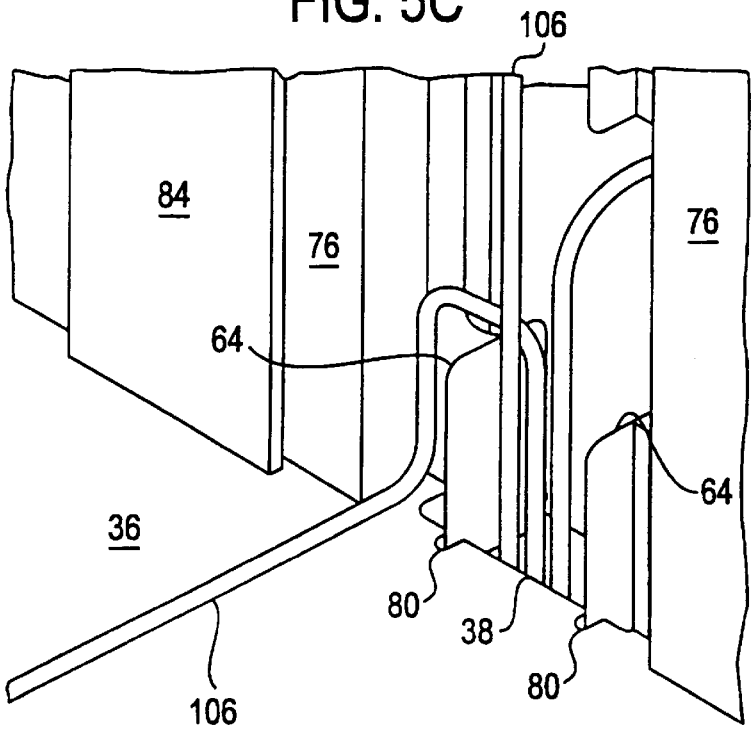
Figure 6:
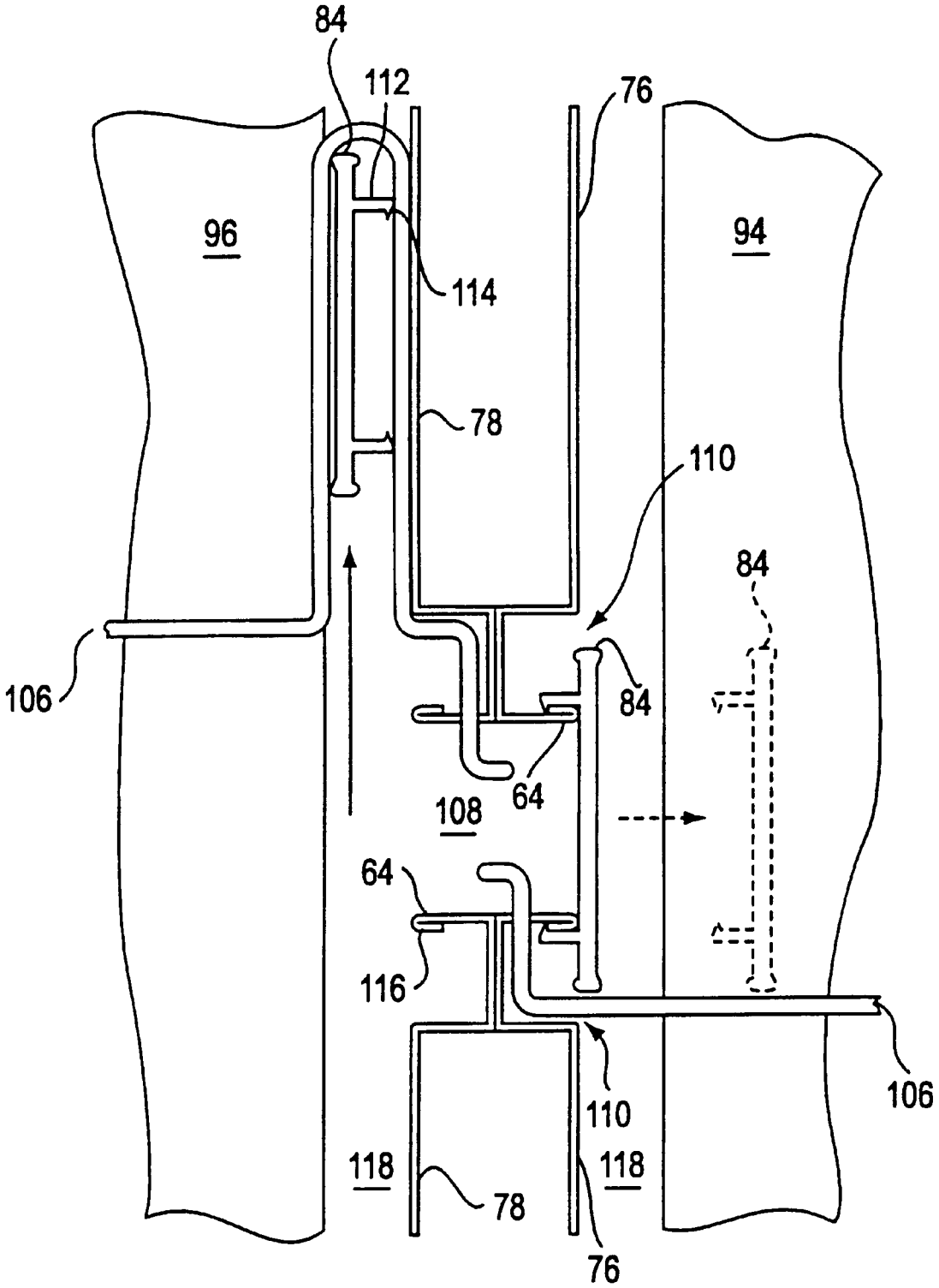
FIG. 6 is a top plan view of the utility management system of FIGS. 5A through 5C.

Referring to FIGS. 4 through 6, a utility management system 104 is shown provided within storage unit 10. As illustrated in FIG. 4, utilities shown as cables 106 may be routed into storage unit 10 at either top aperture 32 of top assembly 14 or base aperture 26 of base assembly 12. According to any preferred embodiment, in application, access to an outside source (or sources) of utilities would typically be provided from through the top aperture if from the ceiling (or a power pole) or from the base aperture if from a subfloor, floor outlet, or base wall outlet or the like; utilities could thus be distributed within and through the storage unit. According to alternative embodiments, the storage unit can be configured or positioned to accommodate other arrangements for obtaining access to utilities and to provide connectivity to electronic equipment or systems (e.g. any type of audio-visual equipment, computing systems, appliances, electronic devices or instruments, etc.) placed within the storage unit.

As shown in FIG. 4, within storage unit 10 cables 106 may pass from upper vertical passage 82 through shelf aperture 37 of fixed shelf assembly 16 and into lower vertical passage 70. Cables 106 may then be routed within storage unit 10, at any height level required, from upper vertical passage 82 into right upper section 46*a* and left upper section 46*b* of storage unit, and from lower vertical passage 70 into right lower section 38*a* and left lower section 38*b* of storage unit 10. For example, as shown in FIG. 4, cable 106 is routed to an article of electronic equipment shown as a video monitor 108 (shown in phantom lines) placed in right upper section 46*a* of storage unit 10 on fixed shelf assembly 16.

Referring to FIGS. 5A through 5C, upper partition assembly 74 is shown with each spine divider 76 according to an exemplary embodiment. Opposed bracket tabs 64 of each spine divider 76 extend within upper vertical passage 82 and may function as hooks or guides for cables 106 routed through or into the storage unit; alternatively, as shown with cable 106*x*, an unobstructed vertical route may be taken through the open center 108 of upper vertical passage 82 between bracket tabs 64. As shown in FIGS. 5B and 5C, when cover 84 is removed, upper vertical passage 82 is completely accessible (notwithstanding the location of intermediate shelves); when cover 84 is installed, a gap 110 is provided at each lateral end of cover 84 between an edge of each spine divider 76 allowing outlet passage for cable 106 onto fixed shelf assembly 16 (cover 84 is shown in phantom lines in FIG. 5A). According to a particularly preferred embodiment shown in FIG. 6, cover 84 (made of a rigid PVC material) is provided with a set of projections 112 (e.g. fins) each having a rim 114 configured to engage a corresponding set of catches 116 provided by opposed bracket tabs 64 so that cover can be "snapped" into place on the partition assembly. As is also shown in FIG. 6, although cover 84 may extend the full height of the section of the storage unit, because intermediate shelves 94 which are installed a small distance from the partition assembly a space 118 is provided for cover 84 to be moved with minimal or minor interference from the installed condition to the removed condition (i.e. cable 106 may be pulled slightly aside when cover 84 is displaced to the removed condition).

According to any preferred embodiment (such as is shown in FIG. 4), the utility management system allows utilities to be substantially freely routed in any direction from or into any section of the storage unit, as well as into or out of the storage unit itself, as may be required for a particular application. According to alternative embodiments, supplemental cable guides, such as cable supports or ties or the like may be used to facilitate routing of utilities within the vertical passages of the utility management system.

Figure 15:
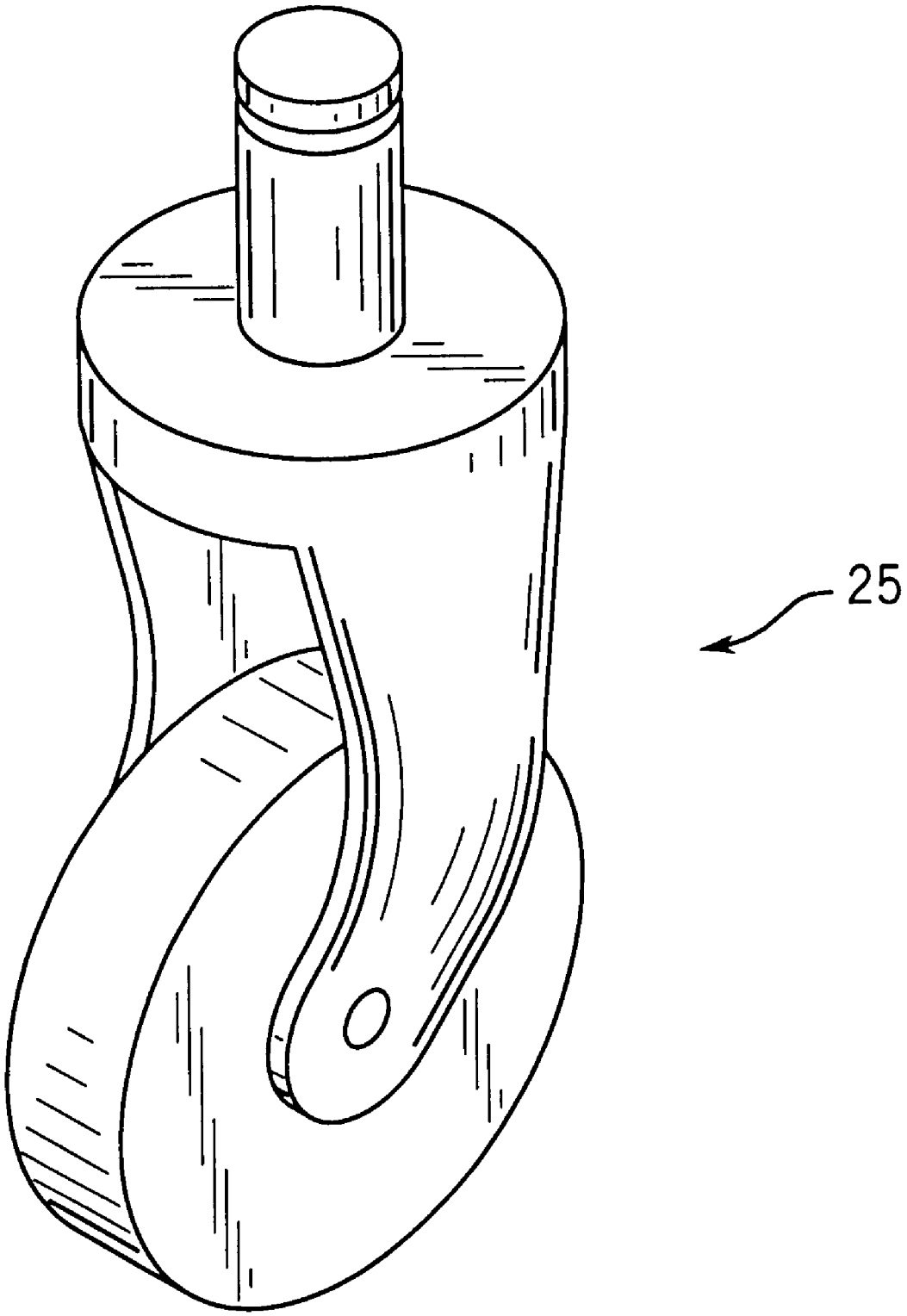
FIG. 15 is a fragmentary perspective view of a wheel according to an alternative embodiment.

As illustrated in the Figures, according to any particularly preferred embodiment, the storage unit is configured to provide for a wide variety of construction and assembly options. It should be noted that at least in part, the wide variety of options is at least partially facilitated by the modularity and/or interchangeability of components within a storage unit and between storage units. (For example, according to a particularly preferred embodiment, the storage unit is of a generally symmetrical construction; the top assembly, the bottom assembly, and the fixed shelf assembly may be of a similar construction and may share components, such as the frames and mounting tubes.) It should also be noted that the storage unit is readily adapted to serve any of a wide range of functions (or combination of functions) to support the activities of individual workers or groups of workers within a work environment, for example, as a basic open storage unit, as a closed storage cabinet, as an audio-visual or computing center, as an appliance cabinet, as a utility distribution hub, as an information display center, as an instructional tool, as a physical space divider, as a decorative element, to name a few functions. Moreover, the storage unit may readily be associated with other articles of furniture, such as partition walls or mobile screens, to form public, private or semi-private work areas for workers in the work environment. According to an alternative embodiment to facilitate mobility and thus provide a mobile storage unit, the glides may be replaced with wheels or casters (e.g. locking casters or another type of caster or wheel, for example the type shown schematically as caster 25 in FIG. 15, which can be installed on each of four mounting tubes beneath the base assembly) of any conventional type that would allow rolling movement of the storage unit along the floor.

Referring to FIGS. 3A through 3E and 10 through 14, the storage unit is shown according to various exemplary embodiments, incorporating in various combinations a variety of modular components. For example, as shown modular components such as exterior panels (serving functional and/or decorative purposes), intermediate shelves, drawers, tubs, containers, articles, pivoting or sliding doors, etc. may be associated with (e.g. with, on, or within) the storage unit. According to alternative embodiments, these modular components and other modular components and systems may be associated with the storage unit in any of a wide variety of other arrangements and combinations. The modular components (and the storage unit itself) may be provided in any of a wide variety of sizes, shapes, proportions, and dimensional relationships.

As shown in the Figures, the storage unit may be adapted to use any of a wide variety of exterior panels, having a wide variety of constructions, finishes and/or surface treatments, intended to support work activities (for example, by allowing the display of information) and/or provide a decorative appearance (for example, to match the appearance of other articles of furniture in the work environment). Examples of exterior panels that may be used in various combinations include but are not limited to whiteboard or markerboard panel, corkboard or tackboard panel, writeable-erasable panel, tablet panel, translucent panel, display panel, tilted display rack panel, wood veneer panel, plastic laminate panel, metal panel, or other functional or decorative panels. Such panels may be mounted in a variety of arrangements for example, such as "captured" within the vertical frame members (see, e.g., panel 88 in FIG. 10) or "floating" outside of the vertical frame members (see, e.g., panel 126 in FIGS. 10 and 11).

Figure 10:
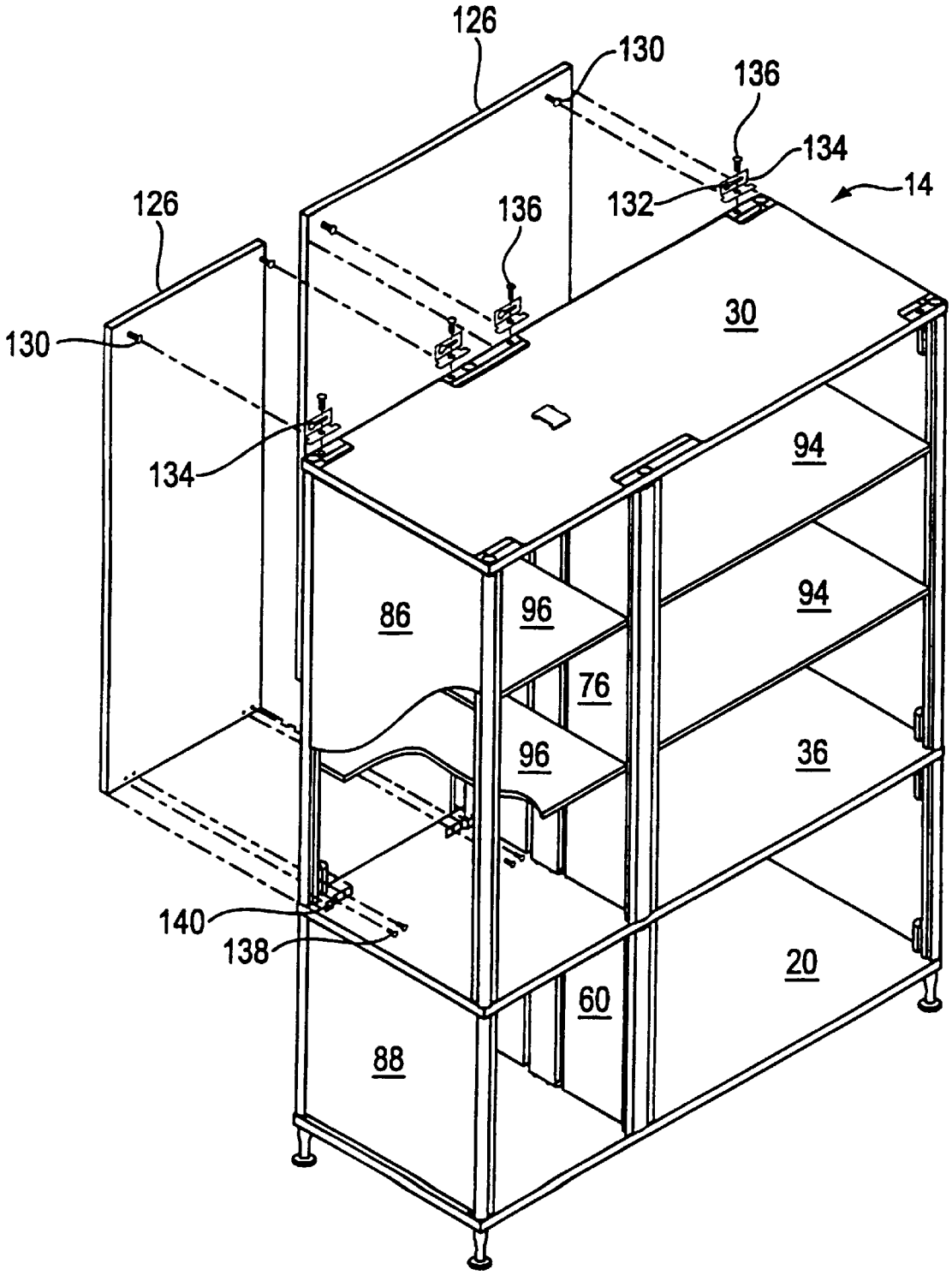
FIG. 10 is a partially exploded perspective view of the storage unit according to an exemplary embodiment.

A mounting interface for a "floating" panel of this type according to an exemplary embodiment is shown in detail in FIG. 10. The back of the panel has tapped or threaded holes into which a fastening element shown as a bolt 130 can be secured by engaging a slot 132 within a mounting bracket 134 secured to top assembly 14 with a fastener shown as a threaded bolt 136; the back of the panel also has two sets of holes adapted to allow for attachment to a mounting bracket 140 secured to upper corner extrusion 48 and upper middle extrusion 50 by screws 138. It should also be noted that although specific mounting arrangements for modular components such as "floating" or "captured" panels are disclosed, according to alternative embodiments, any of a wide variety of known or conventional mounting or installation arrangements could be used. (According to any preferred embodiment, each modular component or panel will be properly secured onto the storage unit according to particular mounting interface requirements determined by the modular component or panel.)

Figure 12:
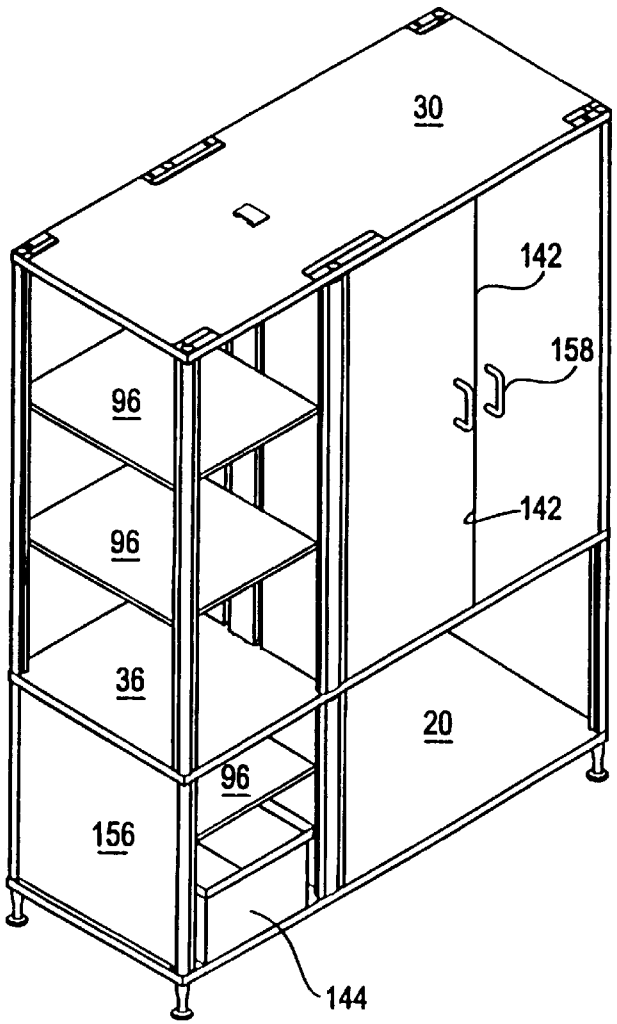
FIGS. 11 through 14 are perspective view of the storage unit according to exemplary embodiments.
Figure 11:
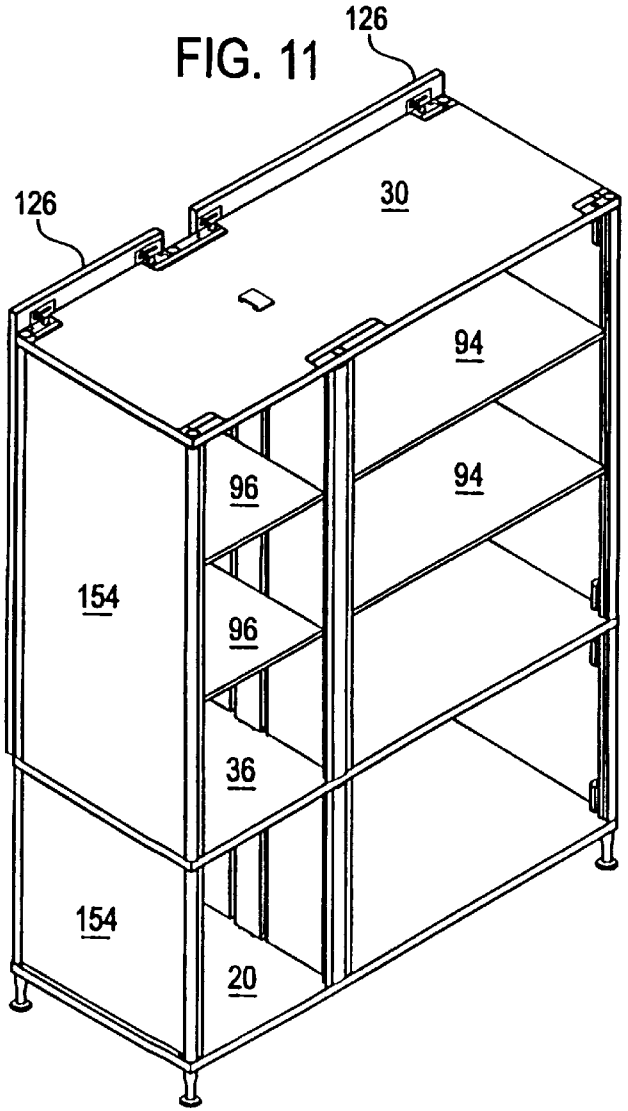
Figure 14:
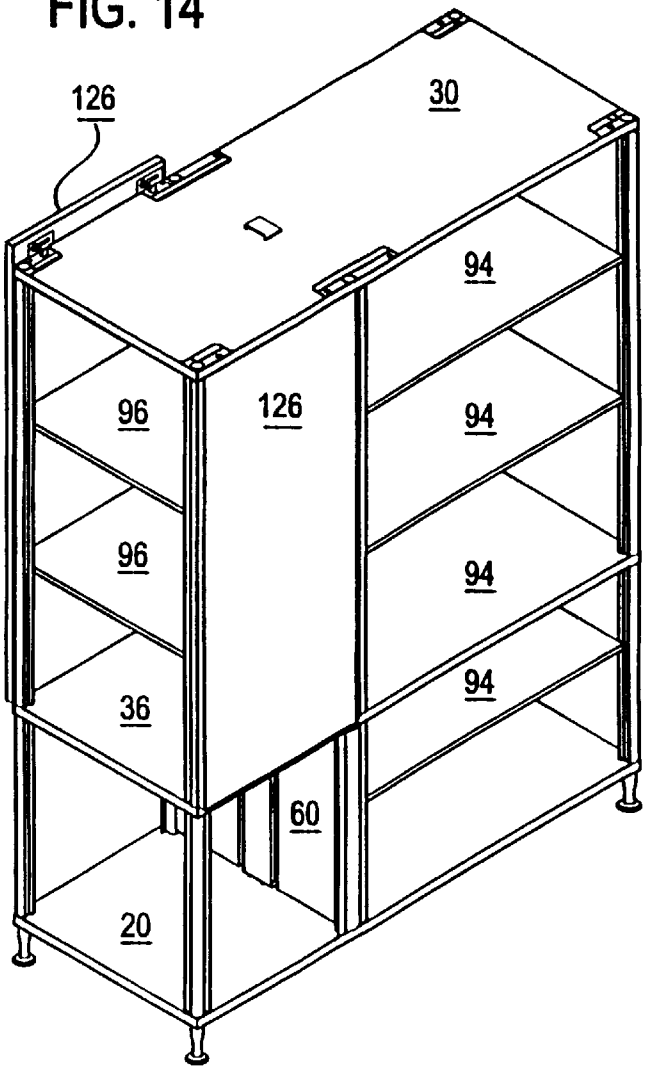
Figure 13:
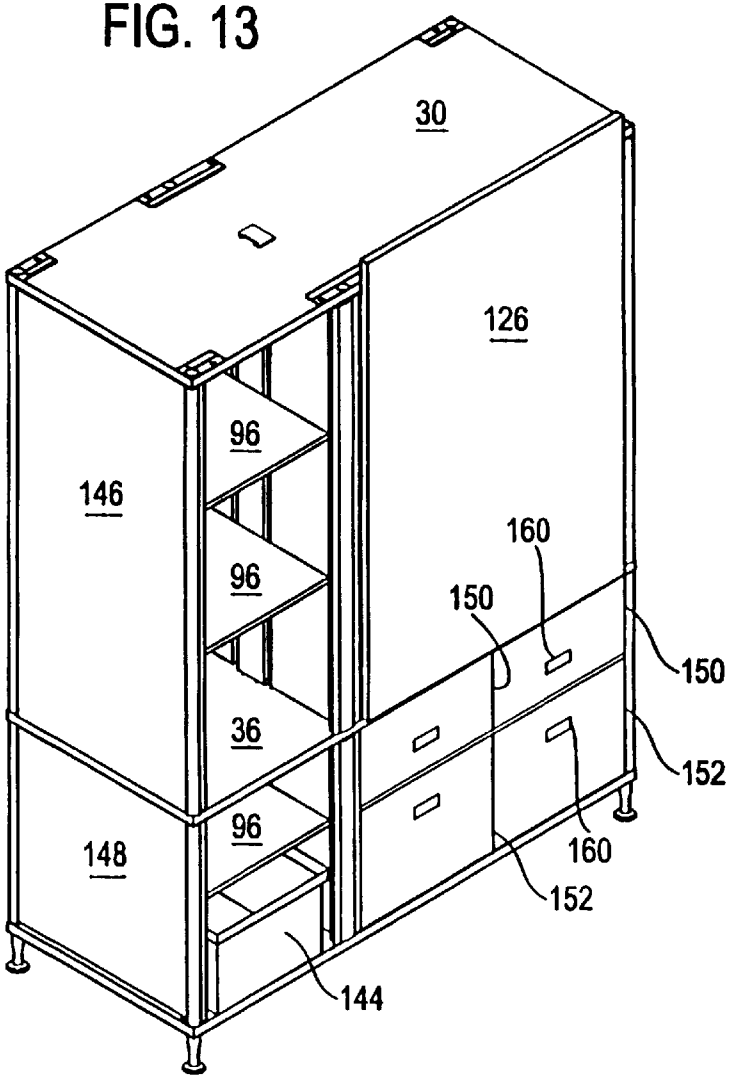

In FIGS. 3A through 3E, storage unit 10 in addition to other modular components such as intermediate shelves 94 and 96, includes a decorative panel 120 (e.g. wood veneer or plastic laminate), a tilted display panel 122 providing a base having attached hanging display racks 124 (e.g. racks having arms with hooks fitted in slots on the panel and a base adapted to hold paper matter such as journals or display boards), a markerboard panel 126, and translucent panels 128. For example, in FIGS. 10 and 11, the storage unit includes a pair of markerboard panels 126. In FIG. 10, the storage unit also includes decorative panels 86 and 88 (shown schematically). In FIG. 11, the storage unit also includes wood veneer panels 154. In FIG. 12, storage unit 10 includes a set of pivoting doors 142 (with handles 158) and a storage tub 144 fit on base assembly 12, as well as plastic laminate panel 156. In FIG. 13, storage unit 10 includes a markerboard panel 126, a tackboard panel 146, a metal panel 148, a storage tub 144 and a set of sliding drawers 150 and 152 (with handles 160). In FIG. 14, storage unit 10 is provided with a pair of markerboard panels 126 and a plurality of intermediate shelves 94 and 96.

It is important to note that the use of the term "information" is meant to cover any use of any type of media or any type of representation that can be associated with a panel or display board. It is also important to note that the use of the term "utilities" is meant to cover any type of electrical or optical or other signal or fluid or the like that can be passed or conducted along or through a conduit (e.g. cable, tube, etc.), including but not limited to power, voice or data, or air or water.

Although only a few exemplary embodiments of the present invention have been described in detail in this disclosure, those skilled in the art who review this disclosure will readily appreciate that many modifications are possible in the exemplary embodiments (such as variations in sizes, structures, shapes and proportions of the various elements, values of parameters, mounting arrangements, or use of materials) without materially departing from the novel teachings and advantages of the invention. Accordingly, all such modifications are intended to be included within the scope of the invention as defined in the appended claims. Other substitutions, modifications, changes and omissions may be made in the design, operating conditions and arrangement of the preferred embodiments without departing from the spirit of the invention as expressed in the appended claims.

What is claimed is:

1. A reconfigurable storage unit for use in a work environment and for passing utilities for at least one of a voice signal, a power signal or a data signal comprising:

a base assembly;

a fixed shelf assembly including a shelf having a shelf aperture and mounted upon the base assembly;

a top assembly mounted upon the fixed shelf assembly;

an upper vertical partition assembly installed between the fixed shelf assembly and the top assembly dividing an upper space between the fixed shelf assembly and the top assembly into a first upper section and a second upper section;

a lower vertical partition assembly installed between the base assembly and the fixed shelf assembly dividing a lower space between the base assembly and the fixed shelf assembly into a first lower section and a second lower section; and a vertical passage provided within the upper vertical partition assembly and the lower vertical partition assembly and in communication with the shelf aperture so that utilities may be passed from the top assembly to the base assembly from at least one of the first upper section or the second upper section to at least one of the first lower section or the second lower section.

2. The storage unit of claim 1 wherein the top assembly has a top aperture so that utilities may be passed through the top assembly to the base assembly through the vertical passage.

3. The storage unit of claim 1 wherein the base assembly has a base aperture so that utilities may be passed from the top assembly through the base assembly through the vertical passage.

4. The storage unit of claim 2 wherein the base assembly has a base aperture so that utilities may be passed through the top assembly through the base assembly through the vertical passage.

5. The storage unit of claim 1 wherein the fixed shelf assembly includes a horizontal shelf.

6. The storage unit of claim 1 wherein the base assembly includes a horizontal shelf.

7. The storage unit of claim 1 wherein the vertical passage further includes at least one cable hook.

8. The storage unit of claim 1 wherein the vertical passage has a first upper outlet in communication with the first upper section and a second upper outlet in communication with the second upper section.

9. The storage unit of claim 1 wherein the vertical passage has a first lower outlet in communication with the first lower section and a second lower outlet in communication with the second lower section.

10. The storage unit of claim 8 wherein the vertical passage has a first lower outlet in communication with the first lower section and a second lower outlet in communication with the second lower section.

11. The storage unit of claim 1 wherein the vertical passage is substantially enclosed by the lower vertical partition assembly and the upper vertical partition assembly.

12. The storage unit of claim 1 wherein the first upper section is substantially enclosed by a panel.

13. A storage unit for use in a work environment providing for routine of cables for at least one of a voice signal, a power signal or a data signal comprising:

a base assembly;

a top assembly mounted upon the base assembly;

a vertical partition installed between the base assembly and the top assembly dividing a space between the base assembly and the top assembly into a first section and a second section;

a fixed shelf assembly including a shelf having a shelf aperture and installed between the base assembly and the top assembly dividing the first section into a first upper section and a first lower section and dividing the second section into a second upper section and a second lower section; and a vertical passage provided within the vertical partition assembly; wherein the vertical passage provides at least one outlet into the first section and at least one outlet into the second section so that cables may be passed through the vertical passage between the top assembly and the base assembly and between the first section and the second section.

14. The storage unit of claim 13 wherein the vertical partition assembly includes an upper vertical partition assembly installed between the fixed shelf assembly and the top assembly and a lower vertical partition assembly installed between the base assembly and the fixed shelf assembly.

15. The storage unit of claim 14 further comprising at least one container adapted for placement on the base assembly.

16. The storage unit of claim 14 further comprising at least one pivoting panel mounted between the fixed shelf assembly and the top assembly for pivotal movement between an open position and a closed position wherein access to the upper section is at least partially restricted.

17. The storage unit of claim 13 wherein the top assembly has a top aperture so that utilities may be passed through the top assembly to the base assembly through the vertical passage.

18. The storage unit of claim 13 wherein the base assembly has a base aperture so that utilities may be passed from the top assembly through the base assembly through the vertical passage.

19. The storage unit of claim 14 wherein the base assembly has a base aperture so that utilities may be passed through the top assembly through the base assembly through the vertical passage.

20. The storage unit of claim 13 wherein the fixed shelf assembly includes a horizontal shelf.

21. The storage unit of claim 13 wherein the base assembly includes a horizontal shelf.

22. The storage unit of claim 13 wherein the top assembly includes a horizontal panel.

23. The storage unit of claim 13 wherein the vertical passage has at least one cable hook.

24. The storage unit of claim 14 wherein the vertical passage has a first upper outlet in communication with the first upper section and a second upper outlet in communication with the second upper section.

25. The storage unit of claim 14 wherein the vertical passage has a first lower outlet in communication with the first lower section and a second lower outlet in communication with the second lower section.

26. The storage unit of claim 24 wherein the vertical passage has a first lower outlet in communication with the first lower section and a second lower outlet in communication with the second lower section.

27. The storage unit of claim 13 wherein the vertical passage is located within an intermediate space of the vertical partition assembly.

28. The storage unit of claim 13 wherein the vertical passage includes a cover.

29. The storage unit of claim 28 wherein the cover includes a plastic strip that at least partially covers the vertical passage.

30. The storage unit of claim 13 further comprising a set of casters installed beneath the base assembly.

31. The storage unit of claim 13 wherein the top assembly and the base assembly are arranged so that the space therebetween has a generally orthogonal shape.

32. The storage unit of claim 13 further comprising removable horizontal shelves adapted for installation between the fixed shelf assembly and the top assembly.

33. The storage unit of claim 13 further comprising at least one exterior panel adapted to be mounted between the base assembly and the top assembly.

34. The storage unit of claim 33 wherein the at least one exterior panel is mounted between the fixed shelf assembly and the top assembly.

35. The storage unit of claim 33 wherein the at least one exterior panel is mounted between the base assembly and the fixed shelf assembly.

36. The storage unit of claim 14 wherein at least one exterior panel is mounted between the upper vertical partition assembly, the fixed shelf assembly and the top assembly to at least partially enclose the first upper section.

37. The storage unit of claim 33 wherein the at least one exterior panel is interchangeable.

38. The storage unit of claim 33 wherein the at least one exterior panel comprises four panels.

39. The storage unit of claim 33 wherein the at least one exterior panel includes a whiteboard.

40. The storage unit of claim 33 wherein the at least one exterior panel includes a tackboard.

41. The storage unit of claim 33 wherein the at least one exterior panel includes a translucent panel.

42. The storage unit of claim 33 wherein the at least one exterior panel includes a writeable surface.

43. The storage unit of claim 33 wherein the at least one exterior panel includes a writeable-erasable surface.

44. The storage unit of claim 33 wherein the at least one exterior panel includes a display rack panel.

45. The storage unit of claim 33 wherein the at least one exterior panel includes a wood veneer panel.

46. The storage unit of claim 33 wherein the at least one exterior panel includes a plastic laminate panel.

47. The storage unit of claim 33 wherein the at least one exterior panel includes a metal sheet panel.

48. The storage unit of claim 13 further comprising a set of glides installed beneath the base assembly.

49. The storage unit of claim 14 wherein the shelf aperture is in communication with the vertical passage.

50. A reconfigurable storage unit for use in a work environment and for routing cables for utilities for at least one of a voice signal, a power signal or a data signal comprising:

a base assembly;

a top assembly mounted upon the base assembly;

a vertical partition assembly installed between the base assembly and the top assembly dividing a space between the base assembly and the top assembly into a first section and a second section;

a vertical passage provided by the vertical partition assembly so that utilities may be passed between the top assembly to the base assembly and between the first section and the second section; and a cover attachable to the vertical partition assembly so that when the cover is installed the vertical passage is at least partially concealed;

wherein the vertical partition assembly includes a plurality of bracket tabs each having a base and a lateral member attached to the base, and projecting at least partially into the vertical passage and providing a surface so that cables may be selectively routed into and out of the vertical passage.

51. The storage unit of claim 50 wherein the vertical partition assembly comprises an upper partition assembly and a lower partition assembly.

52. The storage unit of claim 51 wherein the upper partition assembly comprises at least one divider.

53. The storage unit of claim 52 wherein the at least one divider includes a plurality of tabs.

54. The storage unit of claims 53 wherein the at least one divider comprises two dividers.

55. The storage unit of claim 54 wherein the plurality of tabs are adapted to secure the cover onto the upper partition assembly.

* * * * *